US009429152B2

(12) United States Patent
Yamaji

(10) Patent No.: US 9,429,152 B2
(45) Date of Patent: Aug. 30, 2016

(54) METHOD FOR CONTROLLING VARIABLE DISPLACEMENT PUMP

(71) Applicant: Bosch Rexroth Corporation, Tokyo (JP)

(72) Inventor: Kenpei Yamaji, Ibaraki (JP)

(73) Assignee: Bosch Rexroth Corporation, Tokyo (JP)

( * ) Notice: Subject to any disclaimer, the term of this patent is extended or adjusted under 35 U.S.C. 154(b) by 463 days.

(21) Appl. No.: 13/865,821

(22) Filed: Apr. 18, 2013

(65) Prior Publication Data

US 2013/0230413 A1 Sep. 5, 2013

Related U.S. Application Data

(63) Continuation-in-part of application No. PCT/JP2011/074745, filed on Oct. 27, 2011, and a continuation of application No. PCT/JP2012/055315, filed on Mar. 2, 2012.

(30) Foreign Application Priority Data

Oct. 28, 2010 (JP) ..... 2010-241917

(51) Int. Cl.
*F04B 49/02* (2006.01)
*F04B 17/05* (2006.01)
(Continued)

(52) U.S. Cl.
CPC ..... *F04B 49/02* (2013.01); *F04B 1/26* (2013.01); *F04B 17/05* (2013.01); *F04B 27/24* (2013.01); *F04B 49/22* (2013.01); *F04B 2205/05* (2013.01); *F04B 2207/041* (2013.01)

(58) Field of Classification Search
CPC ..... F04B 17/05; F04B 27/24; F04B 35/002; F04B 1/26; F04B 27/14; F04B 49/106; F04B 2207/041; F04B 2207/0411; F04B 2207/0412; F04B 49/002; F04B 49/02; F04B 49/03; F04B 49/22; F04B 2205/05; F04B 2205/09; F04B 2205/18; F04B 2207/01
See application file for complete search history.

(56) References Cited

U.S. PATENT DOCUMENTS 4,507,057 A * 3/1985 Igarashi et al. ..... 417/216
4,741,159 A * 5/1988 Gunda et al. ..... 60/443
(Continued)

FOREIGN PATENT DOCUMENTS

JP H1047306 2/1998
JP H1061605 3/1998
(Continued)

OTHER PUBLICATIONS

JP 2007-205464 machine transation, Patent Transate, EPO May 27, 2015 8 pages.*
(Continued)

*Primary Examiner* — Bryan Lettman
*Assistant Examiner* — Timothy P Solak
(74) *Attorney, Agent, or Firm* — Michael Best & Friedrich LLP

(57) ABSTRACT

A method for controlling a variable displacement pump by calculation by a controller using a closed-center-type directional control valve, the method allowing effective utilization of the variable displacement pump while avoiding the risk of engine stall is provided. The method includes determining a first virtual discharge pressure and a second virtual discharge pressure. The method includes controlling the variable displacement pump based on a smaller value of the first virtual discharge pressure and the second virtual discharge pressure.

5 Claims, 9 Drawing Sheets

12a:A/D CONVERTER
12b:ARITHMETIC PROCESSING UNIT
12c:D/A CONVERTER

F7-a:HORSE POWER CALCULATION FUNCTION
F7-b:OPERATION AMOUNT

(51) Int. Cl.

| | |
|---|---|
| ***F04B 27/24*** | (2006.01) |
| ***F04B 1/26*** | (2006.01) |
| ***F04B 49/22*** | (2006.01) |

(56) References Cited

U.S. PATENT DOCUMENTS

| | | | | |
|---|---|---|---|---|
| 5,170,625 | A * | 12/1992 | Watanabe et al. | 60/452 |
| 5,967,756 | A * | 10/1999 | Devier et al. | 417/18 |
| 6,282,892 | B1 * | 9/2001 | Arai | 60/450 |
| 2007/0193262 | A1 | 8/2007 | Iwamoto | |

FOREIGN PATENT DOCUMENTS

| | | | | |
|---|---|---|---|---|
| JP | 2000027803 | | 1/2000 | |
| JP | 3471638 | | 12/2003 | |
| JP | 3745038 | | 2/2006 | |
| JP | 200652673 | | 2/2006 | |
| JP | 2007 205464 | * | 8/2007 | F15B 20/00 |
| JP | 2007205464 | | 8/2007 | |
| JP | 2007278457 | | 10/2007 | |
| JP | 201194687 | | 5/2011 | |
| JP | 2012031998 | | 2/2012 | |
| JP | 2000145711 | | 4/2013 | |

OTHER PUBLICATIONS

International Search Report for Application No. PCT/JP2011/074745 dated Feb. 7, 2012 (2 pages).

* cited by examiner

12a:A/D CONVERTER
12b:ARITHMETIC PROCESSING UNIT
12c:D/A CONVERTER

F3-a:VIRTUAL PUMP DISCHARGE FLOW RATE
F3-b:OPERATION AMOUNT

F6-a:DISTRIBUTION RATIO DETERMINATION

F7-a:HORSE POWER CALCULATION FUNCTION
F7-b:OPERATION AMOUNT (a)

(b)

METHOD FOR CONTROLLING VARIABLE DISPLACEMENT PUMP

RELATED APPLICATIONS

The present application is a continuation-in-part of PCT/JP2011/074745 filed Oct. 27, 2011, the entire contents of which are incorporated herein by reference. Further, the present application is a continuation of PCT/JP2012/055315 filed Mar. 2, 2012, the entire contents of which are incorporated herein by reference.

BACKGROUND OF THE INVENTION

The present invention relates to a method for controlling a variable displacement pump applied to a machine, such as a construction machine using a bleed-off hydraulic system.

For a hydraulic circuit used in the field of construction machines including a hydraulic excavator, the applicant has proposed in JP-A-2007-205464 a method for controlling a variable displacement pump, driven by an engine, the pump discharge flow rate of which can be adjusted from the outside, having actuators connected thereto through a plurality of closed-center-type directional control valves, respectively, the closed-center-type directional control valves controlling the variable displacement pump by electrical calculation in place of center-bypass-type directional control valves.

This method intends to mathematically replace a bleed-off characteristics part of a conventional bleed-off hydraulic system including center-bypass-type directional control valves, which is a part for controlling pressure and flow rate for actuators, by controlling discharge pressure of the variable displacement pump by calculation by controller. A conventional variable displacement pump is controlled with some of hydraulic fluid pumped by the variable displacement pump, being actually returned to a tank, failing to effectively utilize the variable displacement pump. However, controlling discharge pressure of a variable displacement pump by calculation by controller as if the variable displacement pump has a bleed-off characteristic allows exclusion of center-bypass paths from directional control valves and discharge of hydraulic fluid with only an actually required flow rate.

For the method for controlling a variable displacement pump described in JP-A-2007-205464, an example is described in which, when calculating a pump discharge pressure specified value (virtual commanded pump discharge pressure Pidea), a pump discharge flow rate Qidea is limited by an upper limit that is an engine horse power He divided by the commanded pump discharge pressure Pidea, as shown in FIG. 7. However, as seen from characteristic curve defining the relation between pump discharge pressure P and discharge flow rate Q (hereinafter sometimes simply referred to as "characteristic curve") shown in FIG. 8, the variable displacement pump is usually controlled such that the pump discharge flow rate Q is kept constant when the pressure P is less than or equal to a predetermined pressure P1, and the product of the discharge pressure P and the discharge flow rate Q is kept constant when the pressure P exceeds the pressure P1. Due to this, when the flow rate of hydraulic fluid supplied to an actuator is low and the discharge pressure P has exceeded the pressure P1, even though the pump discharge flow rate Q can be increased, the obtained calculation result suggests decreasing the commanded pump discharge pressure Pidea, limiting the pump discharge flow rate Q, which may prevent effective utilization of the variable displacement pump.

Also, for the method for controlling a variable displacement pump described in JP-A-2007-205464, another example is described in which the pump discharge pressure specified value (commanded pump discharge pressure Pidea) is calculated without taking the engine horse power into consideration, as shown in FIGS. 9(*a*) and 9(*b*). However, absolutely without taking the engine horse power into consideration, a load of the variable displacement pump may become too high, leading to engine stall.

SUMMARY OF THE INVENTION

In view of the above, it is an object of the present invention to provide a method for controlling a variable displacement pump by calculation by controller using a closed-center-type directional control valve, the method allowing effective utilization of the variable displacement pump while avoiding the risk of engine stall.

In order to solve the above problem, means for resolution is found as follows.

That is, the method for controlling a variable displacement pump of the invention is a method for controlling a variable displacement pump, driven by an engine, the pump discharge flow rate of which can be adjusted from the outside, having an actuator or actuators connected thereto through one or more closed-center-type directional control valves, the closed-center-type directional control valves controlling the variable displacement pump in place of center-bypass-type directional control valves, the method including the steps of: detecting a real discharge flow rate of the variable displacement pump and an operation amount of the directional control valves; determining a first virtual discharge pressure from the real discharge flow rate of the variable displacement pump based on characteristic curve defining the relation between discharge pressure and discharge flow rate of the variable displacement pump; using the real discharge flow rate of the variable displacement pump as an actuator flow rate necessary for the actuators, determining a virtual bleed-off flow rate based on a virtual bleed-off area of the closed-center-type directional control valves determined according to the operation amount, and determining a second virtual discharge pressure of the variable displacement pump based on a value obtained by subtracting the actuator flow rate and the virtual bleed-off flow rate from the virtual discharge flow rate of the variable displacement pump; and controlling the variable displacement pump based on a smaller value of the first virtual discharge pressure and the second virtual discharge pressure.

Furthermore, the invention provides a method for controlling the variable displacement pump wherein, when a plurality of the variable displacement pumps are connected to the engine, and one or more of the actuators are connected to each of the variable displacement pumps through one or more of the closed-center-type directional control valves, the distribution ratio of the horse power of the engine for each of the variable displacement pumps is predetermined or determined according to the operation amount of each of the closed-center-type directional control valves, and the first virtual discharge pressure is determined from each distributed horse power and the real discharge flow rate of each of the variable displacement pumps.

Furthermore, the invention provides a method for controlling the variable displacement pump wherein, for each of the variable displacement pumps, subtracting from the distributed horse power a value obtained by multiplying the real discharge flow rate of each of the variable displacement pumps by a smaller discharge pressure of the first virtual discharge pressure and the second virtual discharge pressure to calculate excess horse power for each of the variable displacement pumps; and determining the first virtual discharge pressure based on a horse power obtained by adding the excess horse power for one of the variable displacement pumps to the distributed horse power for the other of the variable displacement pumps.

Furthermore, the invention provides a method for controlling the variable displacement pump, wherein the first virtual discharge pressure is variable according to the operation amount of the closed-center-type directional control valves.

Note that the term "closed-center-type directional control valve" used herein refers to a valve configured to cause a spool at a neutral position not to bypass hydraulic fluid. Also, note that the term "center-bypass-type directional control valve" used herein refers to a valve configured to cause a spool at a neutral position to bypass hydraulic fluid. Also, note that the term "negative type" refers to a type in which an output value gradually decreases as an input value increases, and the term "positive type" refers to a type in which an output value gradually increases as an input value increases.

According to the method for controlling a variable displacement pump of the invention, in a situation in which engine stall is not likely to occur, the pump discharge pressure specified value may be determined without taking the engine horse power calculation into consideration, allowing the variable displacement pump to be effectively utilized. On the other hand, in a situation in which a load of the variable displacement pump is high and engine stall is likely to occur, the pump discharge pressure specified value is determined taking the engine horse power into consideration, which can prevent engine stall.

Furthermore, varying the distribution ratio of the horse power for each of the pumps depending on the operation condition can give a priority to each actuator, which may improve the operability and allows further effective utilization of the engine horse power.

DETAILED DESCRIPTION

Embodiments of a method for controlling a variable displacement pump in accordance with the invention are described below in detail with reference to the drawings.

1. Total Configuration of Hydraulic Circuit

First, one configuration example of a hydraulic circuit to which a method for controlling a variable displacement pump in accordance with a first embodiment of the invention can be applied is described.

Figure 1:
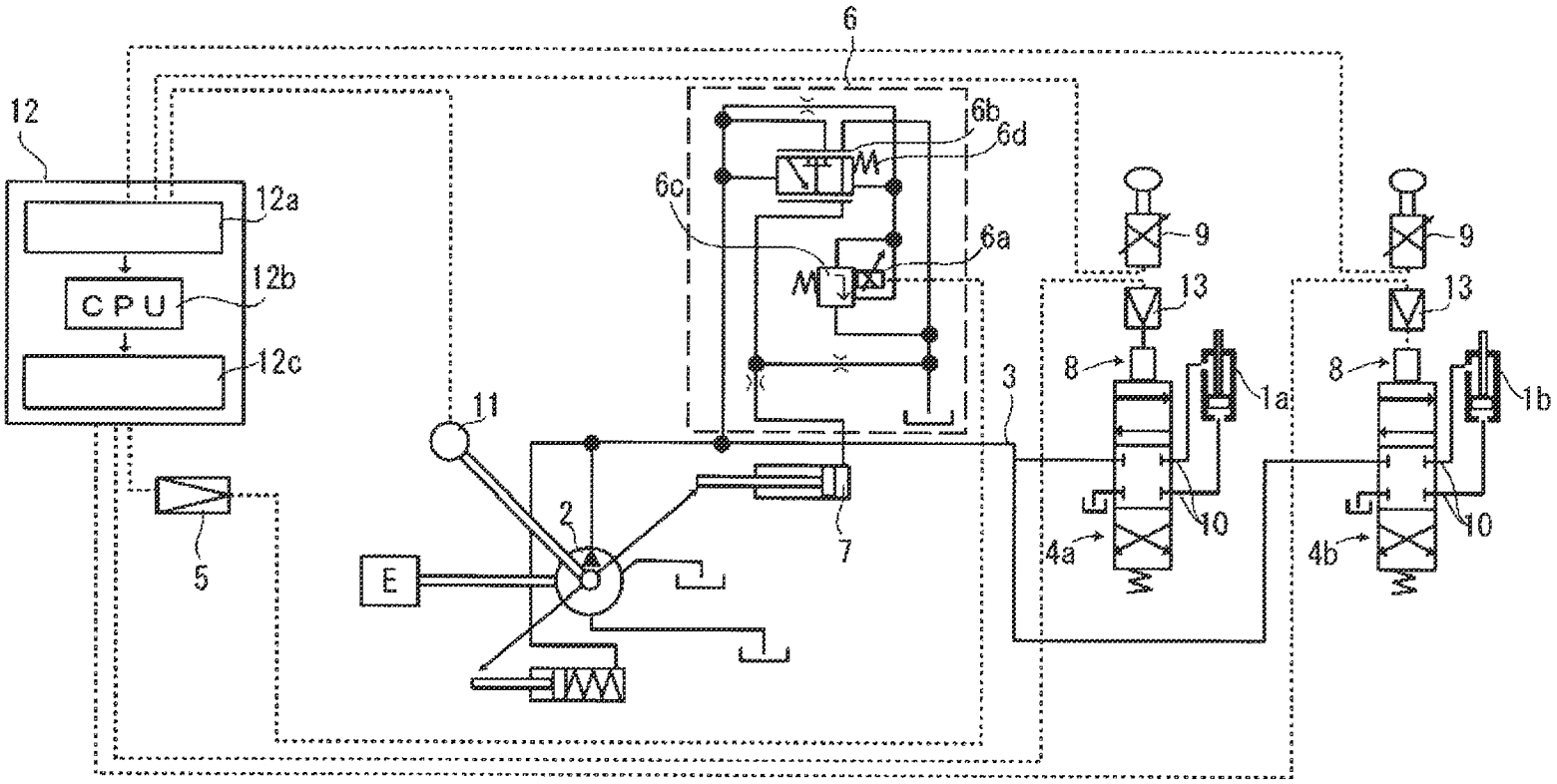
FIG. 1 is a hydraulic circuit diagram illustrating a method for controlling a variable displacement pump of a first embodiment of the invention.

FIG. 1 shows a basic example of a hydraulic circuit that controls operation of a plurality of hydraulic actuators 1*a*, 1*b* and is applied to a hydraulic excavator or the like. The actuators 1*a*, 1*b* are connected to a discharge circuit 3 of a variable displacement pump 2 driven by an engine E, through closed-center-type directional control valves 4*a*, 4*b*, respectively. The variable displacement pump 2 is a well-known one, such as an axial piston pump having a pump displacement control mechanism, such as a swash plate.

The output of a solenoid drive amplifier 5 as a command input and the discharge-side pressure of the variable displacement pump 2 as a feedback input are connected to the input side of a pump pressure controller 6. A control piston 7 is connected to the output side of the pump pressure controller 6.

The pump pressure controller 6 includes a control valve 6*b* and a negative electromagnetic proportional valve 6*c*. A real pump discharge pressure Preal of the variable displacement pump 2, an elastic force of a spring 6*d* and a pressure signal P'c controlled by the negative electromagnetic proportional valve 6*c* act on both ends of the spool of the control valve 6*b*, in which the areas of the both ends of the spool appropriately differs from each other and then the control valve 6*b* is appropriately controlled according to a balance between them.

The negative electromagnetic proportional valve 6*c* is a valve that serves as a proportional relief valve, and is controlled according to a balance among a spring force, the pressure signal P'c on the input side opposite to the spring force and a force, generated by a proportional solenoid 6*a*, that is varied in proportion to a control current input based on a control signal P'tgt from a controller 12.

The closed-center-type directional control valves 4*a*, 4*b* include a proportional solenoid 8 for moving a spool. When a solenoid drive amplifier 13 is activated by an operation lever 9, such as an electric joystick, via the controller 12, the proportional solenoid 8 is excited according to the tilt angle of the operation lever 9. This causes the spool of the closed-center-type directional control valves 4*a*, 4*b* to move to a desired position to control the opening area of an actuator port 10 according to the movement distance. As a result, hydraulic fluid is supplied to the actuators 1*a*, 1*b* at the flow rate according to the opening area.

The specified amount, such as the tile angle of the operation lever 9, for operating the closed-center-type directional control valves 4*a*, 4*b*, or the movement distance of the spool of the closed-center-type directional control valves 4*a*, 4*b* is electrically detected by a sensor, then the specified amount or movement distance having been detected is converted into an operation amount signal S according to the operation amount of the closed-center-type directional control valves 4*a*, 4*b*. In the example shown in FIG. 1, an electric command signal transmitted from the operation lever 9 through the controller 12 to the solenoid drive amplifier 13 is used as the operation amount signal S.

However, since the closed-center-type directional control valves 4*a*, 4*b* are actually valves having no bleed-off passage, if a little leakage of hydraulic fluid into a circuit is negligible, a real pump discharge flow rate Qreal of the variable displacement pump 2 becomes almost equal to an actuator flow rate Qa. In the hydraulic circuit described in this embodiment, the plurality of actuators 1*a*, 1*b* are connected to a single variable displacement pump 2, then the actuator flow rate Qa refers to a total sum of the flow rate of hydraulic fluid supplied to the actuator 1*a*, 1*b* through the actuator port 10 in all of the closed-center-type directional control valves 4*a*, 4*b*.

In this embodiment, a tilt amount sensor 11 is provided in the variable displacement pump 2. Then, the real pump discharge flow rate Qreal can be calculated by multiplying the tilt amount detected by the tilt amount sensor 11 by the rotational frequency of the variable displacement pump 2. Since there is almost no leakage of hydraulic fluid from the closed-center-type directional control valves 4*a*, 4*b*, the calculated value of the real pump discharge flow rate Qreal can be used as an estimated value Qai of the actuator flow rate Qa (hereinafter referred to as "estimated actuator flow rate Qai").

For a method for detecting the real pump discharge flow rate Qreal, for example, if the variable displacement pump 2 is a swash plate type variable displacement pump or radial pump, the real pump discharge flow rate Qreal can also be detected using a potentiometer or the like.

In this embodiment, the controller 12 includes an A/D converter 12*a*, a calculator 12*b* and a D/A converter 12*c*. The controller 12 performs arithmetic processing based on various electric signals input to the controller 12. The calculator 12*b* performs arithmetic processing shown by a block diagram within a dot line B in FIG. 2.

2. Method for Controlling a Variable Displacement Pump

Next, a method for controlling the variable displacement pump 2 performed by arithmetic processing by the controller 12 is specifically described.

In this embodiment, the controller 12 compares the maximum discharge pressure Pmax of the variable displacement pump 2, a first virtual discharge pressure Pidea1 determined based on characteristic curve defining the relation between discharge pressure P and discharge flow rate Q of the variable displacement pump 2, and a second virtual discharge pressure Pidea2 determined based on the operation amount signal S, then selects the minimum value among them as a pump discharge pressure specified value Ptgt to control the variable displacement pump 2.

Note that the inclusion of the maximum discharge pressure Pmax of the variable displacement pump 2 into the comparison is to prevent a discharge pressure more than or equal to the maximum discharge pressure Pmax of the variable displacement pump 2 from being specified as the pump discharge pressure specified value Ptgt of the variable displacement pump 2. However, the maximum discharge pressure Pmax is not necessarily required for embodying the invention.

The first virtual discharge pressure Pidea1 is determined by calculation of the engine horse power based on the real pump discharge flow rate Qreal of the variable displacement pump 2. Specifically, as described above, the real pump discharge flow rate Qreal can be determined by multiplying the tilt amount detected by the tilt amount sensor 11 by the rotational frequency of the variable displacement pump 2. Then, the real pump discharge flow rate Qreal is converted to the first virtual discharge pressure Pidea1 based on characteristic curve defining the relation between discharge pressure P and discharge flow rate Q of the variable displacement pump 2. The product of the discharge pressure P and the discharge flow rate Q of the variable displacement pump 2 represents the engine horse power. The first virtual discharge pressure Pidea1 is intended to set an upper limit of the discharge flow rate Q of the variable displacement pump 2 in terms of the engine horse power. Note that the characteristic curve is preferably such that the discharge flow rate Q is kept constant against the discharge pressure P when the pressure P is less than or equal to a predetermined pressure P1, and the product of the discharge pressure P and the discharge flow rate Q is kept constant when the pressure P exceeds the pressure P1.

Figure 2:
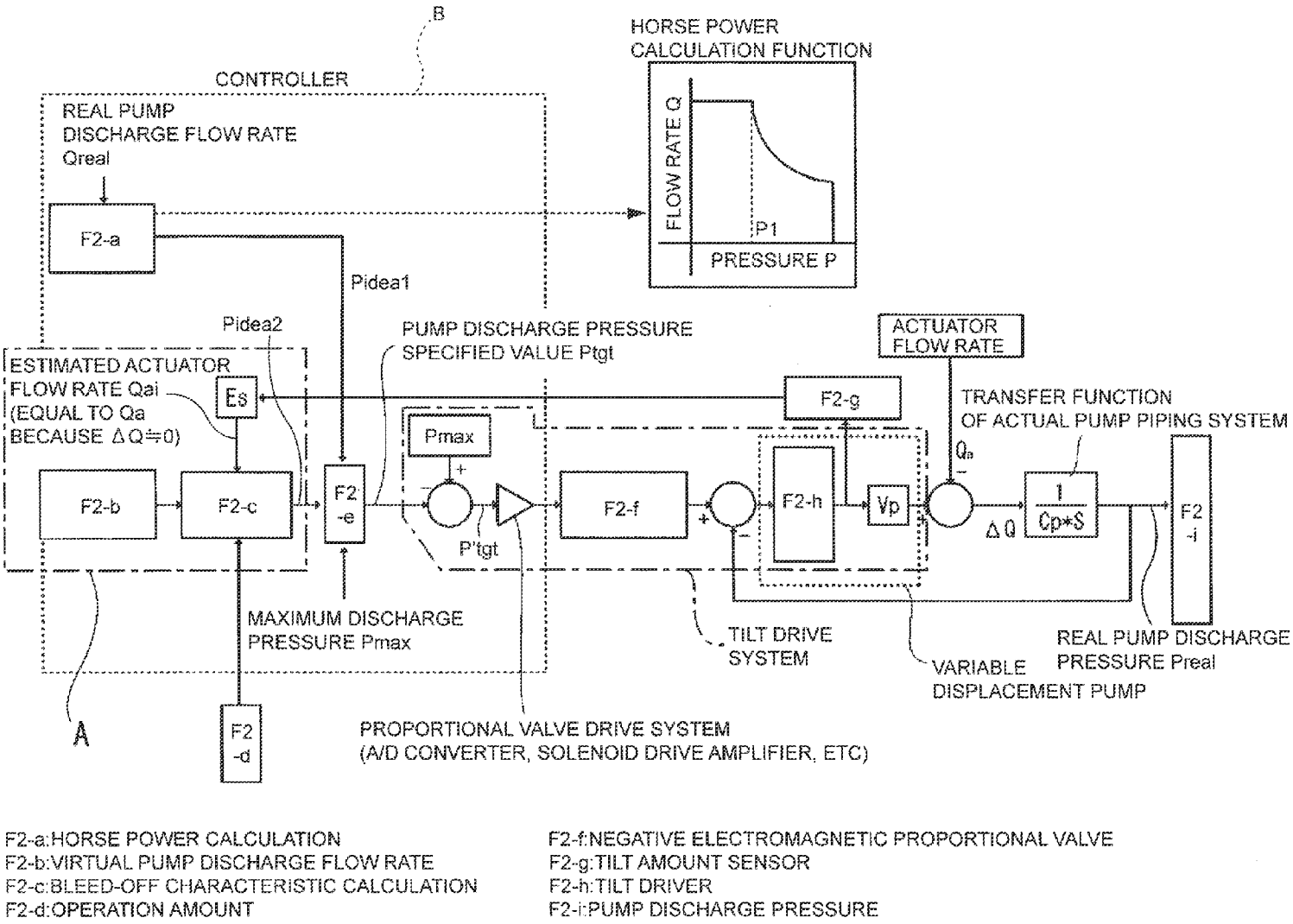
FIG. 2 is a block diagram illustrating the control in FIG. 1.
Figure 3:
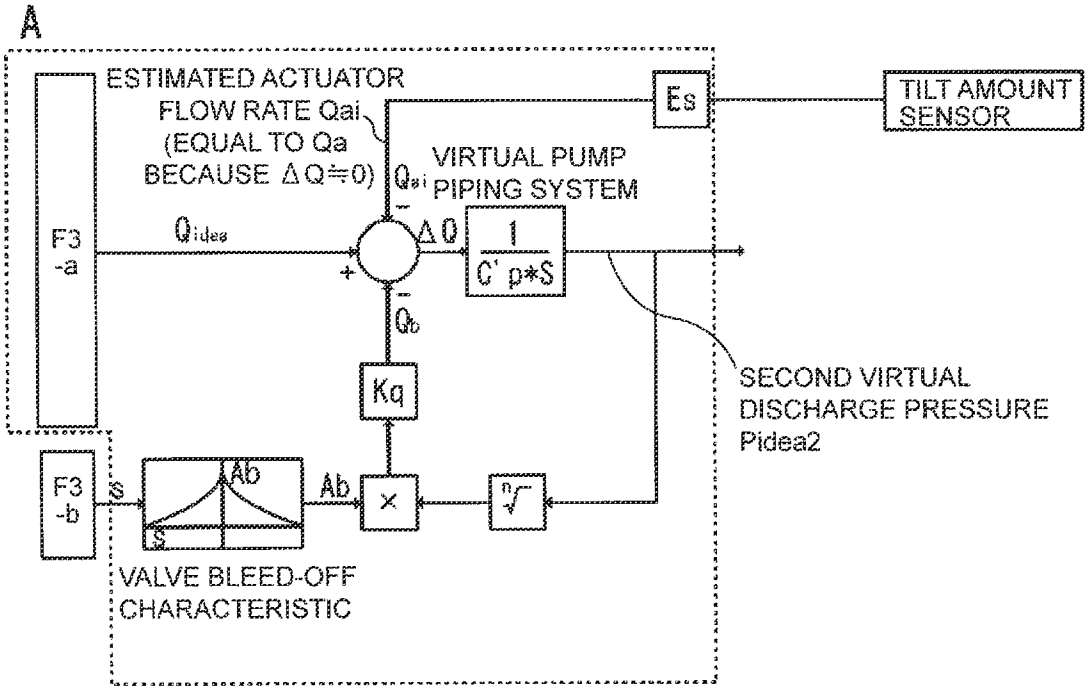
FIG. 3 is a diagram illustrating a block within an alternate long and short dash line A in FIG. 2.

The second virtual discharge pressure Pidea2 is determined by arithmetic processing shown within an alternate long and short dash line A in FIG. 2 based on the operation amount signal S of the closed-center-type directional control valves 4*a*, 4*b* through a process different from the process of determining the first virtual discharge pressure Pidea1 based on the characteristic curve. An example of the arithmetic processing within the alternate long and short dash line A in FIG. 2 is specifically described with reference to FIG. 3.

First, the virtual pump discharge flow rate Qidea of the variable displacement pump 2 is set to a predetermined value. As described later, since the second virtual discharge pressure Pidea2 is calculated in a closed loop manner based on a flow rate value ΔQ obtained by subtracting the estimated actuator flow rate Qai and a virtual bleed-off flow rate Qb from the virtual pump discharge flow rate Qidea, the value of the virtual pump discharge flow rate Qidea may be appropriately set. For example, since the maximum discharge flow rate Qmax of the variable displacement pump 2 is known, this value may be used. In this embodiment, the maximum discharge flow rate Qmax of the variable displacement pump 2 is used as the virtual pump discharge flow rate Qidea.

Next, the input of the operation amount signal S of the closed-center-type directional control valves 4*a*, 4*b* is received, then the opening area Ab of a virtual bleed-off passage of the closed-center-type directional control valves 4*a*, 4*b* corresponding to the operation amount signal S is determined based on a virtual bleed-off characteristic that is previously stored. While not shown in FIG. 3, the input of an operation amount signal Sk of a plurality of closed-center-type directional control valves 4*a*, 4*b* is received, then a total sum of the operation amount signal Sk, that is S1+S2+ . . . +Sn, is used as the total operation amount signal S. In this step, weighting or appropriate arithmetic processing may be applied to the individual inputs.

The determined virtual opening area Ab is multiplied by the square root of the second virtual discharge pressure Pidea2 having been calculated at this time, and further multiplied by a flow rate coefficient Kq of a center-bypass-type directional control valve to determine the virtual bleed-off flow rate Qb. Of course, actual closed-center-type directional control valves 4*a*, 4*b* are of a closed-center type having no bleed-off passage, so the value of the opening area Ab of the virtual bleed-off passage is for calculation purpose. This virtual bleed-off characteristic is defined by predetermining the relation between the virtual opening area Ab and the operation amount signal S for the closed-center-type directional control valves 4*a*, 4*b* that are used, using design technique similar to that of the bleed-off characteristic of a center-bypass-type directional control valve for a conventional bleed-off hydraulic system.

Then, the estimated actuator flow rate Qai and the virtual bleed-off flow rate Qb are subtracted from the virtual pump discharge flow rate Qidea to determine the flow rate value ΔQ (ΔQ=Qidea−Qai−Qb). At this time, actually, there is almost no leakage of hydraulic fluid from the closed-center-type directional control valves 4*a*, 4*b*. So, assuming that the amount of leakage is zero, the real pump discharge flow rate Qreal of the variable displacement pump 2 becomes equal to the actuator flow rate Qa. Thus, the value of the real pump discharge flow rate Qreal can be used as the estimated actuator flow rate Qai. The second virtual discharge pressure Pidea2 can be calculated by dividing the determined flow rate value ΔQ by a piping compression coefficient C'p of a pump piping system and integrating the division result, using a digital filter or the like.

After determining the first virtual discharge pressure Pidea1 and the second virtual discharge pressure Pidea2 in this way, the controller 12 compares the first virtual discharge pressure Pidea1, the second virtual discharge pressure Pidea2 and the maximum discharge pressure Pmax of the variable displacement pump 2, and selects the minimum value among them as the pump discharge pressure specified value Ptgt. Then, the controller 12 controls the discharge pressure of the variable displacement pump 2 in a closed loop manner based on the control signal P'tgt obtained by inverting the pump discharge pressure specified value Ptgt by subtracting the pump discharge pressure specified value Ptgt from the maximum discharge pressure Pmax of the pump.

That is, the solenoid drive amplifier 5 receives the control signal P'tgt from the controller 12 to control the strength of the excitation of the proportional solenoid 6*a* of the negative electromagnetic proportional valve 6*c*. As a result, the pressure of the negative electromagnetic proportional valve 6*c* is proportionally controlled in inverse proportion to the strength of the excitation, i.e., according to the pump discharge pressure specified value Ptgt, which correspondingly operates the control valve 6*b*. Accordingly, the control piston 7 actuates a pump displacement control mechanism to control the pump displacement, i.e., pump discharge flow rate, to increase or decrease. Accordingly, the discharge pressure of the variable displacement pump 2 is controlled to increase or decrease, which controls the control valve 6*b* against the pressure of the negative electromagnetic proportional valve 6*c*. Since the pump discharge pressure is thus controlled in a closed loop manner, the real pump discharge pressure Preal becomes almost equal to the value of the pump discharge pressure specified value Ptgt.

Note that, in this embodiment, the negative electromagnetic proportional valve 6*c* is used, which can drive the variable displacement pump 2 with a maximum pressure when the control signal P'tgt is not output. However, a positive electromagnetic proportional valve may be used instead of the negative electromagnetic proportional valve. In this case, the process of inverting the pump discharge pressure specified value Ptgt is omitted, and the pump discharge pressure specified value Ptgt is taken to be equal to the control signal P'tgt.

In this embodiment, in most of the operation range, i.e., in a situation in which engine stall is not likely to occur, the second virtual discharge pressure Pidea2 that is less than the first virtual discharge pressure Pidea1 is used as the pump discharge pressure specified value Ptgt for the control. The control of the variable displacement pump 2 in which the second virtual discharge pressure Pidea2 is used as the pump discharge pressure specified value Ptgt is performed as follows.

For example, when the operation lever 9 is not operated, the closed-center-type directional control valves 4*a*, 4*b* are at a neutral position and the operation amount signal S input to the controller 12 is zero. In this case, since the opening area Ab of the virtual bleed-off passage calculated by the controller 12 reaches its maximum value, the second virtual discharge pressure Pidea2, i.e., the pump discharge pressure specified value Ptgt, takes a small value. The variable displacement pump 2 discharges hydraulic fluid according to the pump discharge pressure specified value Ptgt. Once the real pump discharge pressure Preal of the discharge circuit 3 of the pump piping system is compressed and pressurized to the pump discharge pressure specified value Ptgt, the real pump discharge flow rate Qreal will need only a little leakage from the circuit.

On the other hand, when the operation lever 9 is operated to cause the closed-center-type directional control valves 4*a*, 4*b* to be shifted toward a switching position, the opening area Ab of the virtual bleed-off passage calculated by the controller 12 decreases. Then, since the virtual bleed-off flow rate Qb decreases, the flow rate value ΔQ increases. Then, as a result of integrating this, the pump discharge pressure specified value Ptgt increases. Accordingly, for a given operation amount, the virtual bleed-off flow rate Qb increases and the flow rate value ΔQ converges to zero, so the pump discharge pressure specified value Ptgt converges to a value at which a balance between the virtual pump discharge flow rate Qidea and the virtual bleed-off flow rate Qb is achieved, and becomes balanced. At this time, the variable displacement pump 2 discharges hydraulic fluid according to the pump discharge pressure specified value Ptgt, in which the real pump discharge flow rate Qreal will need only a little leakage from the circuit as when the operation lever 9 is not operated.

If the real pump discharge pressure Preal is higher than the load pressure of the actuators 1*a*, 1*b*, the actuators 1*a*, 1*b* move and hydraulic fluid starts to flow. Then, in order to maintain the real pump discharge pressure Preal at the pump discharge pressure specified value Ptgt, the real pump discharge flow rate Qreal increases. Then, since the moving speed of the actuators increases, the estimated actuator flow rate Qai increases and the flow rate value ΔQ becomes a negative value and decreases. Due to this, the pump discharge pressure specified value Ptgt decreases and the virtual bleed-off flow rate Qb decreases. Then, decrease in the pump discharge pressure specified value Ptgt and thus the real pump discharge pressure Preal causes the acceleration of the actuators to decrease. Then, the real pump discharge flow rate Qreal and the real pump discharge pressure Preal gradually converge to values at which the actuator speed corresponding to the operation amount is maintained, and become balanced. During this transition, the bleed-off operation is performed only by calculation by the controller 12, and the real pump discharge flow rate Qreal corresponds to only the amount supplied to the actuators 1*a*, 1*b* if the leakage into the circuit is negligible.

Accordingly, since there is no flow corresponding to the bleed-off flow rate, the pump works efficiently. Also, the closed-center-type directional control valves 4*a*, 4*b* do not need a bleed-off passage, which provides simple and low-cost configuration and good operability. Furthermore, the pump discharge flow rate is not limited by a horse power characteristic of the engine, which further improves the pump efficiency.

On the other hand, when the second virtual discharge pressure Pidea2 is used as the pump discharge pressure specified value Ptgt for the control, if it is attempted to increase the discharge flow rate of the variable displacement pump 2 despite of the engine load being large, engine stall may occur. However, in such a case, the second virtual discharge pressure Pidea2 calculated based on the operation amount signal S of the closed-center-type directional control valves 4*a*, 4*b* will exceed the first virtual discharge pressure Pidea1 calculated based on the horse power characteristic of the engine, so the first virtual discharge pressure Pidea1 will be used as the pump discharge pressure specified value Ptgt for the control. Thus, according to the method for controlling a variable displacement pump in accordance with the embodiment, when engine stall is likely to occur, the pump discharge pressure specified value Ptgt will be switched to the first virtual discharge pressure Pidea1, to avoid the occurrence of engine stall.

3. Advantage of the Method of the First Embodiment

As described above, by controlling the variable displacement pump 2 according to the method for controlling a variable displacement pump in accordance with this embodiment, in most of the operation range, i.e., in a situation in which engine stall is not likely to occur, the second virtual discharge pressure Pidea2 that is less than the first virtual discharge pressure Pidea1 is used as the pump discharge pressure specified value Ptgt for the control. The second virtual discharge pressure Pidea2 itself is determined without taking engine horse power into consideration, allowing the variable displacement pump 2 to be used at maximum efficiency. On the other hand, with high engine load, the second virtual discharge pressure Pidea2 calculated will exceed the first virtual discharge pressure Pidea1, so the first virtual discharge pressure Pidea1 will be used as the pump discharge pressure specified value Ptgt for the control. Thus, when engine stall is likely to occur, the real pump discharge flow rate Qreal of the variable displacement pump 2 is controlled based on the engine horse power, which can prevent engine stall.

For a method for controlling a variable displacement pump in accordance with a second embodiment of the invention, in a hydraulic circuit configured using the plurality of actuators 1*a*, 1*b*, . . . , 1*n* similarly to that in FIG. 1, a method for calculating the second virtual discharge pressure Pidea2 is different from that of the method for controlling a variable displacement pump in accordance with the first embodiment. Now, the method for controlling a variable displacement pump in accordance with this embodiment is described below with reference to a block diagram shown in FIG. 4.

Figure 4:
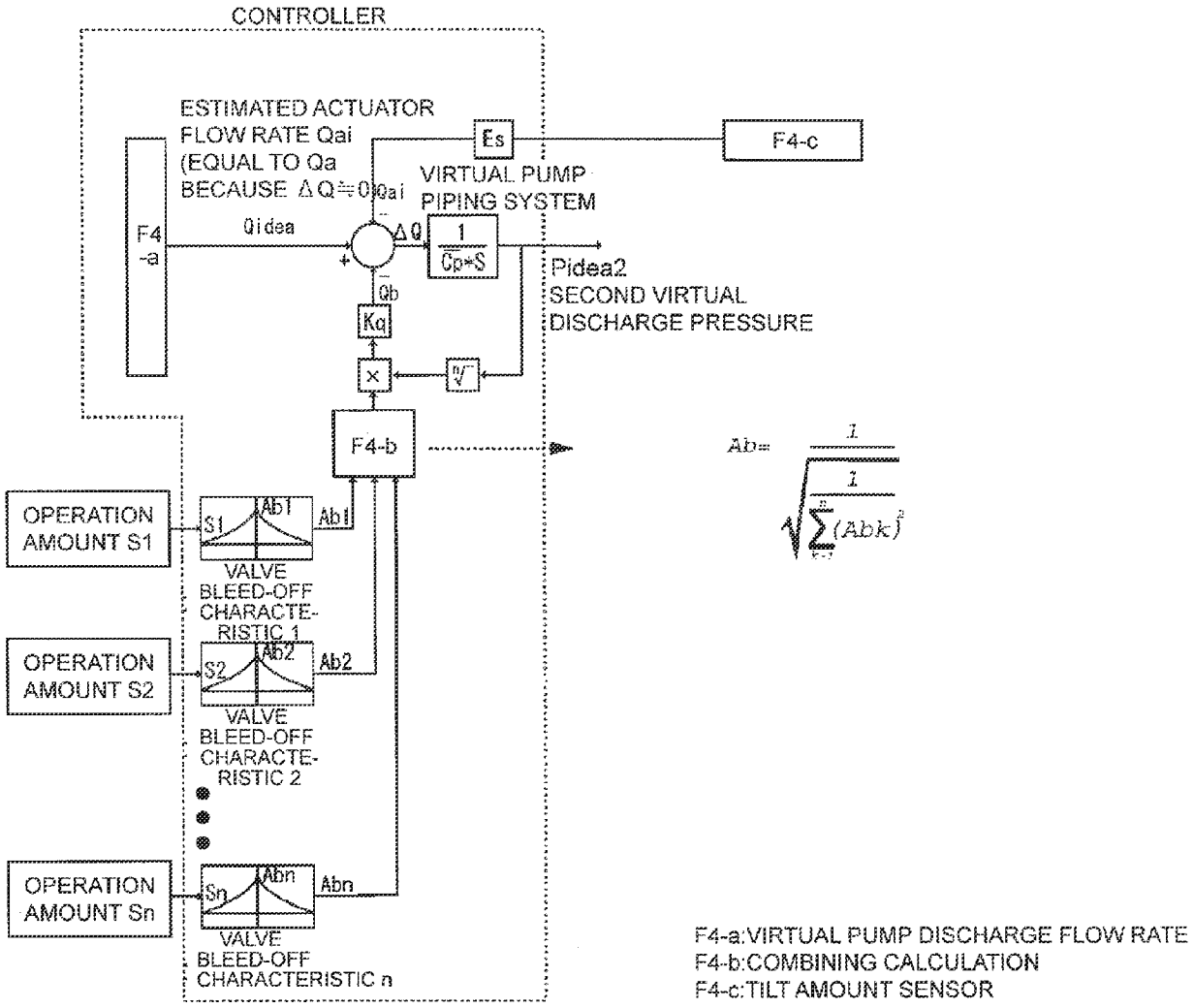
FIG. 4 is a block diagram illustrating a second embodiment of the invention.

FIG. 4 illustrates another method for calculating the second virtual discharge pressure Pidea2, showing arithmetic processing by the controller 12 shown within the alternate long and short dash line A in FIG. 2.

In FIG. 4, the controller 12 receives the input of operation amounts S1, S2, . . . , Sk, . . . , Sn of the plurality of closed-center-type directional control valves 4*a*, 4*b*, . . . , 4*n*, then determines the opening area Ab of a total virtual bleed-off passage of the closed-center-type directional control valves 4*a*, 4*b*, . . . , 4*n* corresponding to virtual bleed-off characteristics for the received operation amounts, by combining calculation using the following equation: Note that Abk in the equation refers to a virtual bleed-off area Abk of each of the closed-center-type directional control valves 4*a*, 4*b*, . . . , 4*n*, which correlates with each operation amount signal Sk, as previously described.

$$Ab = \frac{1}{\sqrt{\sum_{k=1}^{n} \frac{1}{(Abk)^2}}}$$

After determining the opening area Ab of the virtual bleed-off passage by combining calculation in this way, the remaining part of this method is similar to that of the method for calculating the second virtual discharge pressure Pidea2 described in the first embodiment. That is, the determined virtual opening area Ab is multiplied by the square root of the second virtual discharge pressure Pidea2 having been calculated at this time, and further multiplied by a flow rate coefficient Kq of a center-bypass-type directional control valve to determine the virtual bleed-off flow rate Qb.

By controlling the variable displacement pump 2 according to the method for controlling a variable displacement pump in accordance with this embodiment, in most of the operation range, i.e., in a situation in which engine stall is not likely to occur, the second virtual discharge pressure Pidea2 that is less than the first virtual discharge pressure Pidea1 is used as the pump discharge pressure specified value Ptgt for the control, which can provide operability satisfying individual actuators' demand characteristics. The second virtual discharge pressure Pidea2 itself is determined without taking engine horse power into consideration, allowing the variable displacement pump 2 to be used at maximum efficiency. On the other hand, with high engine load, the second virtual discharge pressure Pidea2 calculated will exceed the first virtual discharge pressure Pidea1, so the first virtual discharge pressure Pidea1 will be used as the pump discharge pressure specified value Ptgt for the control. Thus, when engine stall is likely to occur, the real pump discharge flow rate Qreal of the variable displacement pump 2 is controlled based on the engine horse power, which can prevent engine stall.

A method for controlling a variable displacement pump in accordance with a third embodiment of the invention is a method for controlling a variable displacement pump in which a plurality of the variable displacement pumps are connected to an engine, and an actuator is connected to each of the variable displacement pumps through a closed-center-type directional control valve.

The method for controlling a variable displacement pump in accordance with this embodiment can be implemented in a way similar to the method for controlling a variable displacement pump in accordance with the first embodiment except that the first virtual discharge pressure Pidea1 is determined based on characteristic curve defining the relation between discharge pressure P and discharge flow rate Q of the variable displacement pump. Now, the third embodiment of the invention is described below with reference to FIG. 5.

Note that, in the case that a plurality of variable displacement pumps are provided in a hydraulic circuit like this embodiment, the first virtual discharge pressure Pidea1, the second virtual discharge pressure Pidea2 and the pump discharge pressure specified value Ptgt are determined for each variable displacement pump.

Figure 5:
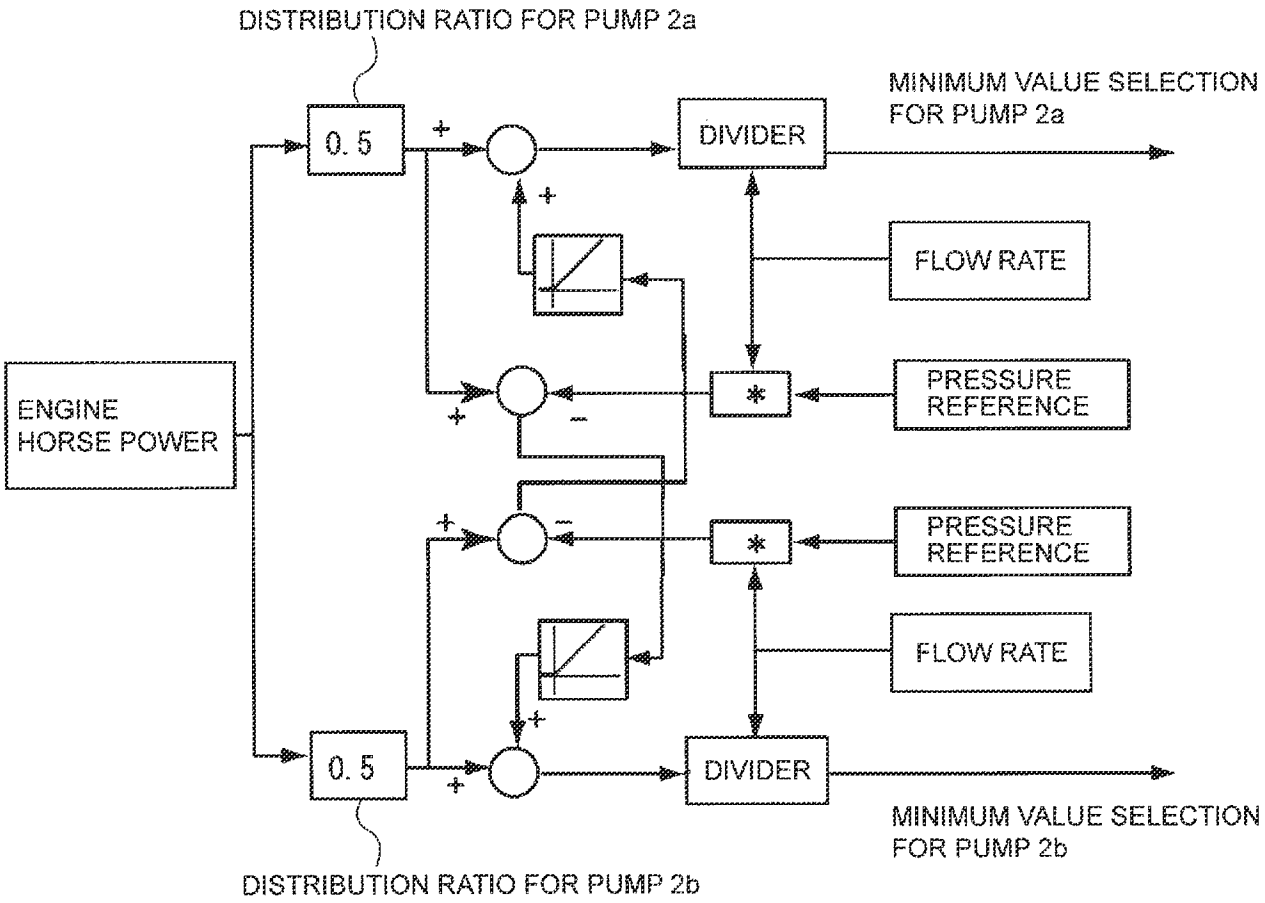
FIG. 5 is a block diagram illustrating a third embodiment of the invention.

FIG. 5 illustrates a method for calculating the first virtual discharge pressure Pidea1 by the controller in the method for controlling a variable displacement pump in accordance with this embodiment, showing an variation of the block labeled as "HORSE POWER CALCULATION" in the block diagram shown in FIG. 2. For the shown example, assume that two variable displacement pumps 2*a*, 2*b* are connected to an engine. Also, for ease of explanation, assume that closed-center-type directional control valves 4*a*, 4*b* and actuators 1*a*, 1*b* are connected to the variable displacement pumps 2*a*, 2*b*, respectively. In the example shown in FIG. 5, horse power of the engine is predetermined to be distributed to each of the variable displacement pumps 2*a*, 2*b* with a distribution ratio of 0.5. Then, the controller 12 calculates the first virtual discharge pressure Pidea1 of each of the variable displacement pumps 2*a*, 2*b* according to the horse power distributed to each of the variable displacement pumps 2*a*, 2*b* and the real pump discharge flow rate Qreal of each of the variable displacement pumps 2*a*, 2*b*.

Also, in the example shown in FIG. 5, for each of the variable displacement pumps 2*a*, 2*b*, the controller 12 subtracts a value obtained by multiplying the real pump discharge flow rate Qreal of each of the variable displacement pumps 2*a*, 2*b* by the pump discharge pressure specified value Ptgt from the distributed horse power to calculate excess horse power of each of the variable displacement pumps 2*a*, 2*b*. Then, the horse power available to one of the variable displacement pumps 2*a* (2*b*) is obtained by adding excess horse power of the other of the variable displacement pumps 2*a* (2*b*) to the horse power distributed to the one of the variable displacement pumps 2*a* (2*b*).

According to this configuration, in addition to the effect obtained by the method for controlling a variable displacement pump in accordance with the first embodiment, an effect can be obtained that excess of the horse power distributed to each of the variable displacement pumps 2*a*, 2*b* can be effectively utilized.

Note that three or more variable displacement pumps may also be connected to a single engine. Also in this case, excess horse power of one of the variable displacement pumps can be effectively utilized in the other of the variable displacement pumps.

Figure 6:
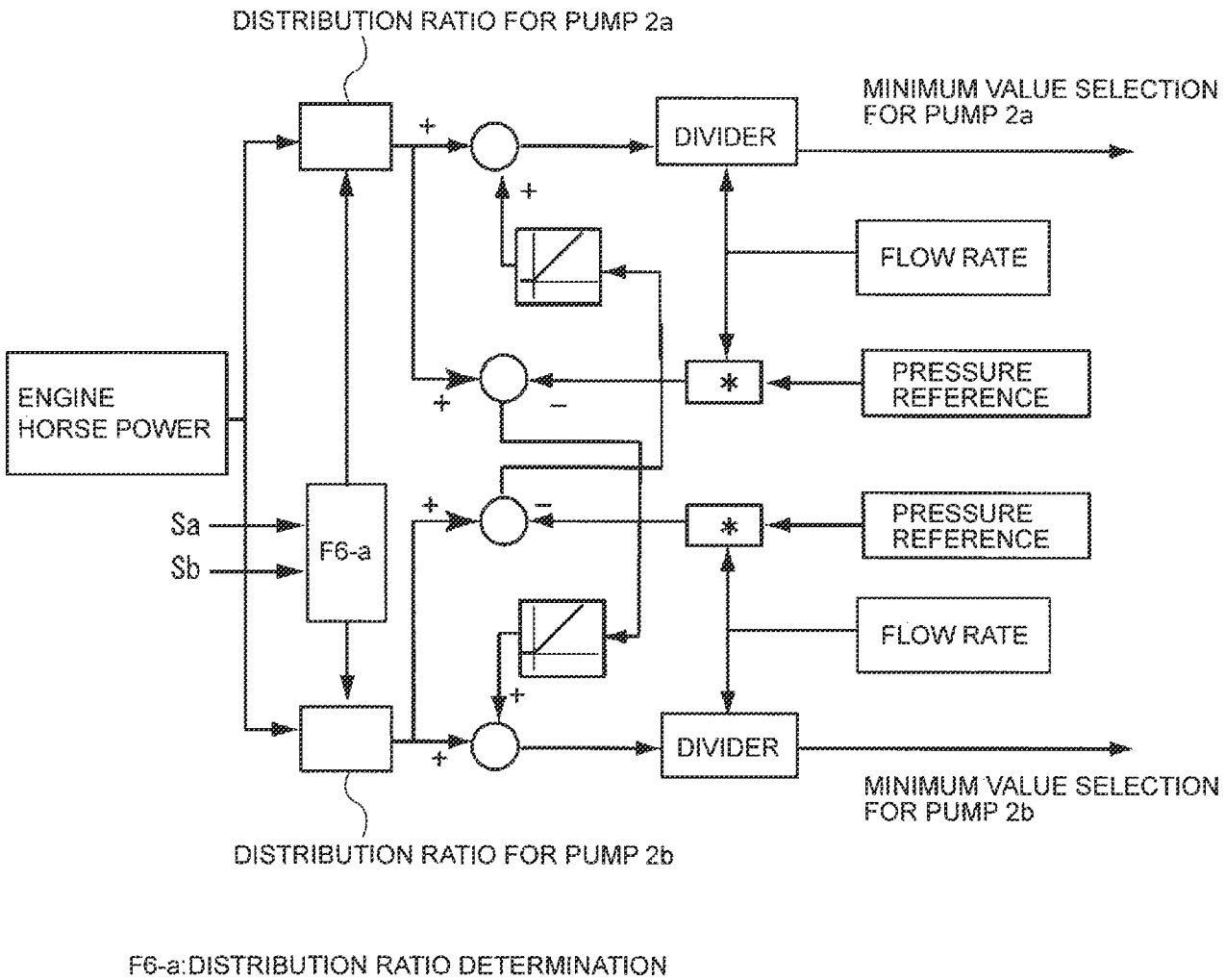
FIG. 6 is a block diagram illustrating a variation of the third embodiment of the invention.
Figure 7:
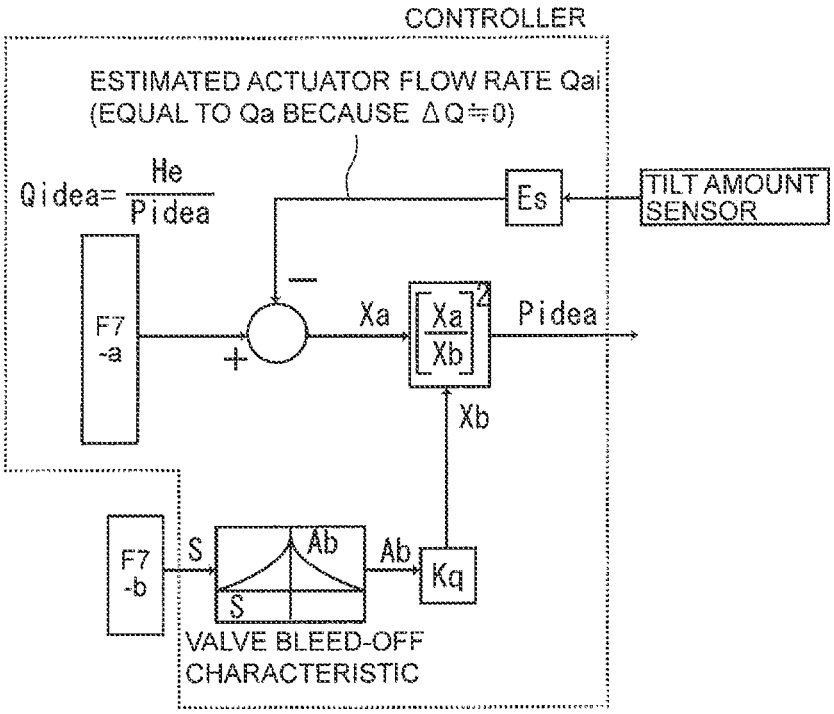
FIG. 7 is a block diagram illustrating a conventional bleed-off characteristic calculation.
Figure 8:
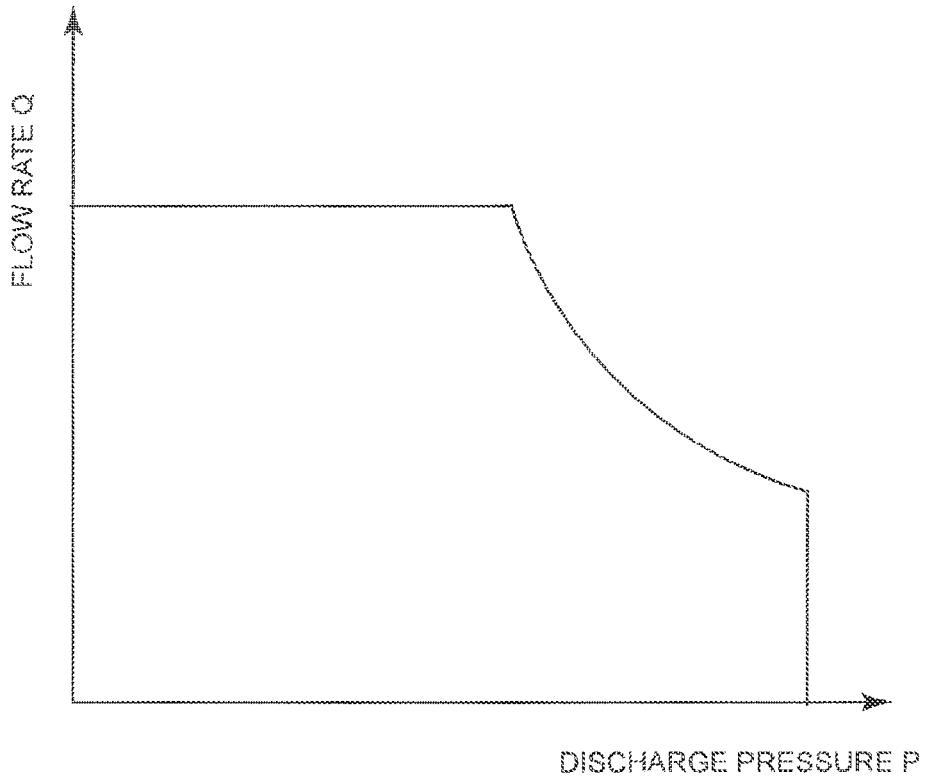
Fig.8 Prior Art
FIG. 8 is a diagram showing characteristic curve defining the relation between discharge pressure and discharge flow rate of the pump.
Figure 9:
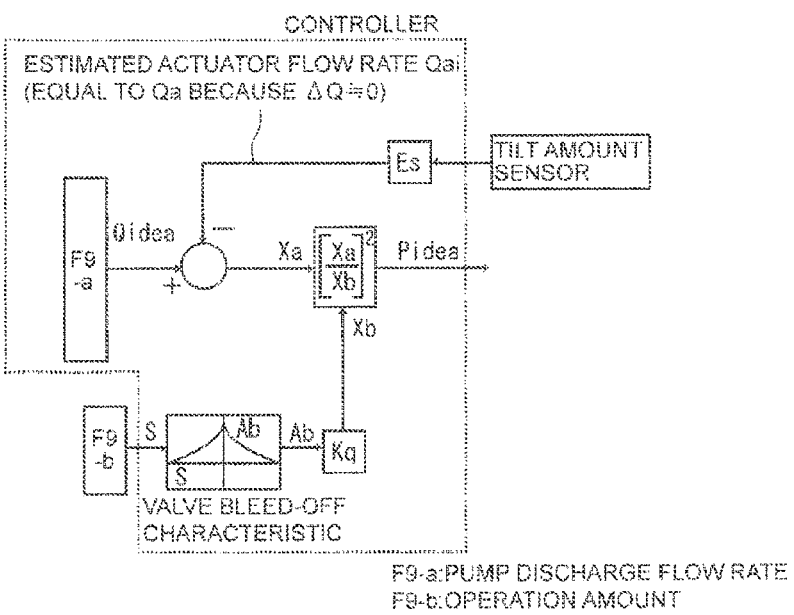
Fig.9 Prior Art
FIG. 9 is a block diagram illustrating a conventional bleed-off characteristic calculation.
Figure 9:
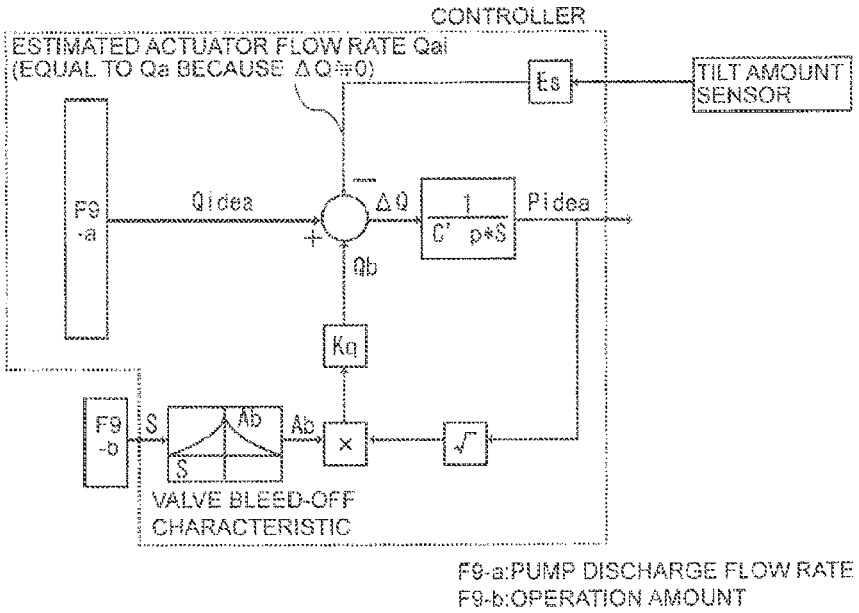
Fig.9 Prior Art

Furthermore, FIG. 6 illustrates an application example of the third embodiment. In the example shown in FIG. 6, the distribution ratio of the engine horse power for each of the variable displacement pumps 2*a*, 2*b* is not predetermined, but determined according to the operation amount of the closed-center-type directional control valves 4*a*, 4*b*. In this step, weighting or appropriate arithmetic processing may be applied to each of the variable displacement pumps 2*a*, 2*b*. According to the configuration of this variation, the distribution ratio of the horse power available to the variable displacement pumps 2*a*, 2*b* to which an actuator under higher load pressure reflecting the operation amount of each of the actuators 1*a*, 1*b* connected to the variable displacement pumps 2*a*, 2*b* or an higher-priority actuator in terms of operation is connected is adjusted. Thus, the operability is improved and the engine horse power can be effectively utilized, so the variable displacement pumps 2*a*, 2*b* can be further effectively utilized.

As described above, according to the method for controlling a variable displacement pump in accordance with the third embodiment, in addition to the effect obtained by the method of the first embodiment, an effect can be obtained that the engine horse power can be effectively utilized.

Note that a plurality of actuators may be connected to one or more of the plurality of variable displacement pumps connected to the engine. In this case, the method for calculating the second virtual discharge pressure Pidea2 of the second embodiment may be appropriately combined to be implemented.

The first to third embodiments described above illustrate only an example of embodiments of the invention. These embodiments may be appropriately varied within the range of the object of the invention.

For example, if the discharge flow rate of a variable displacement pump is configured to increase in a quadric manner according to the operation amount of an actuator, when operating a single actuator, resistance in a meter-in restrictor can be decreased and energy loss can be avoided, and when operating multiple actuators, meter-in diversion control effect can be improved and actuators having different loads can be operated in combination (see a block to which flow rate is added in FIGS. 5 and 6).

What is claimed is:

1. A method for controlling a variable displacement pump, driven by an engine, a pump discharge flow rate of which can be adjusted from the outside, the variable displacement pump having an actuator or actuators connected thereto through one or more closed-center-type directional control valves, the method comprising:

detecting a real discharge flow rate of the variable displacement pump and an operation amount of the directional control valves;

determining a first virtual discharge pressure from the real discharge flow rate of the variable displacement pump based on a characteristic curve defining a relation between discharge pressure and discharge flow rate of the variable displacement pump;

using the real discharge flow rate of the variable displacement pump as an actuator flow rate necessary for the actuators, determining a virtual bleed-off flow rate based on a virtual bleed-off area of the closed-center-type directional control valves determined according to the operation amount, and determining a second virtual discharge pressure of the variable displacement pump so that a flow rate value obtained by subtracting the actuator flow rate and the virtual bleed-off flow rate from a virtual discharge flow rate of the variable displacement pump converges to zero; and controlling the variable displacement pump based on a smaller value of the first virtual discharge pressure and the second virtual discharge pressure wherein a plurality of the variable displacement pumps are connected to the engine, wherein one or more of the actuators are connected to each of the variable displacement pumps through one or more of the closed-center-type directional control valves, wherein horse power is distributed to the variable displacement pumps, and a distribution ratio of the horse power of the engine to each of the variable displacement pumps is predetermined or determined according to the operation amount of each of the closed-center-type directional control valves, and the first virtual discharge pressure for each of the variable displacement pumps is determined from the distributed horse power and the real discharge flow rate of each of the variable displacement pumps;

wherein for each of the variable displacement pumps, the method includes subtracting from the distributed horse power a value obtained by multiplying the real discharge flow rate by the smaller of the discharge pressure of the first virtual discharge pressure and the second virtual discharge pressure to calculate excess horse power for each of the variable displacement pumps, and adding the excess horse power for a first one of the variable displacement pumps to the distributed horse power for at least one of the other of the variable displacement pumps.

2. The method for controlling a variable displacement pump according to claim 1, wherein the second virtual discharge pressure is variable according to the operation amount of the closed-center-type directional control valves.

3. The method for controlling a variable displacement pump according to claim 1, wherein the virtual discharge flow rate is a known, maximum discharge flow rate of the variable displacement pump.

4. The method for controlling a variable displacement pump according to claim 1, wherein the step of determining the second virtual discharge pressure includes dividing the determined flow rate value by a piping compression coefficient of a pump piping system and integrating the division result.

5. The method for controlling a variable displacement pump according to claim 1, further comprising determining an updated first virtual discharge pressure of one of the variable displacement pumps, based on the added excess horse power.

* * * * *